US005211017A

United States Patent [19]

Pusic

[11] Patent Number: 5,211,017

[45] Date of Patent: May 18, 1993

[54] EXTERNAL COMBUSTION ROTARY ENGINE

[76] Inventor: Pavo Pusic, 164 McKinley Ave., East Hanover, N.J. 07936

[21] Appl. No.: 840,824

[22] Filed: Feb. 25, 1992

Related U.S. Application Data

[63] Continuation-in-part of Ser. No. 585,291, Sep. 19, 1990, abandoned.

[51] Int. Cl.[5] ..... F02G 1/044

[52] U.S. Cl. ..... 60/519; 60/525

[58] Field of Search ..... 60/519, 525, 526

[56] References Cited

U.S. PATENT DOCUMENTS

| | | | |
|---|---|---|---|
| 3,426,525 | 2/1969 | Rubin | 60/519 |
| 3,762,167 | 10/1973 | Wahnschaffe | 60/519 |
| 4,179,890 | 12/1979 | Hanson | 60/519 |

OTHER PUBLICATIONS

Copy of Article from Toyo Kogyo Company Ltd

One copy each of pages 358, 367, 383 & 396 of publication entitled "United Stirling Engines".

Pages 458–463 of publicaiton entitled "The Motor Vehicle" (Eleventh Edition) by K. Newton, et al. (Butterworth Int. (1989).

*Primary Examiner*—Allen M. Ostrager

*Attorney, Agent, or Firm*—Marks & Murase

[57] ABSTRACT

An external combustion rotary engine having a configuration which allows spatial separation of the heaters and coolers, and a process which enables rotary motion of the rotors to be performed without internal combustion.

The engine includes the triangular rotors enclosed inside the housings shaped in the form of an epitrochoid curve, the heat generating units, and the heat absorbing and discharging units. The heat generating units and the heat absorbing and discharging units are located outside the housings and connected to the housings.

The engine can also include the ultrasonic fuel atomizers inside the heat generating units and the turbine for the purpose of rapid acceleration.

The present invention provides the simple, compact, lightweight, extremely energy-efficient and environmentally clean engine.

17 Claims, 8 Drawing Sheets

Fig. 1.
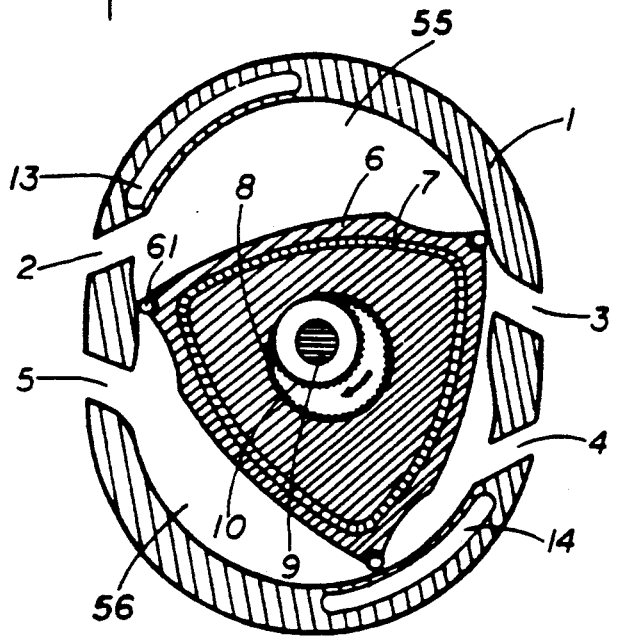
SECOND PORTION OF THE WORKING GAS
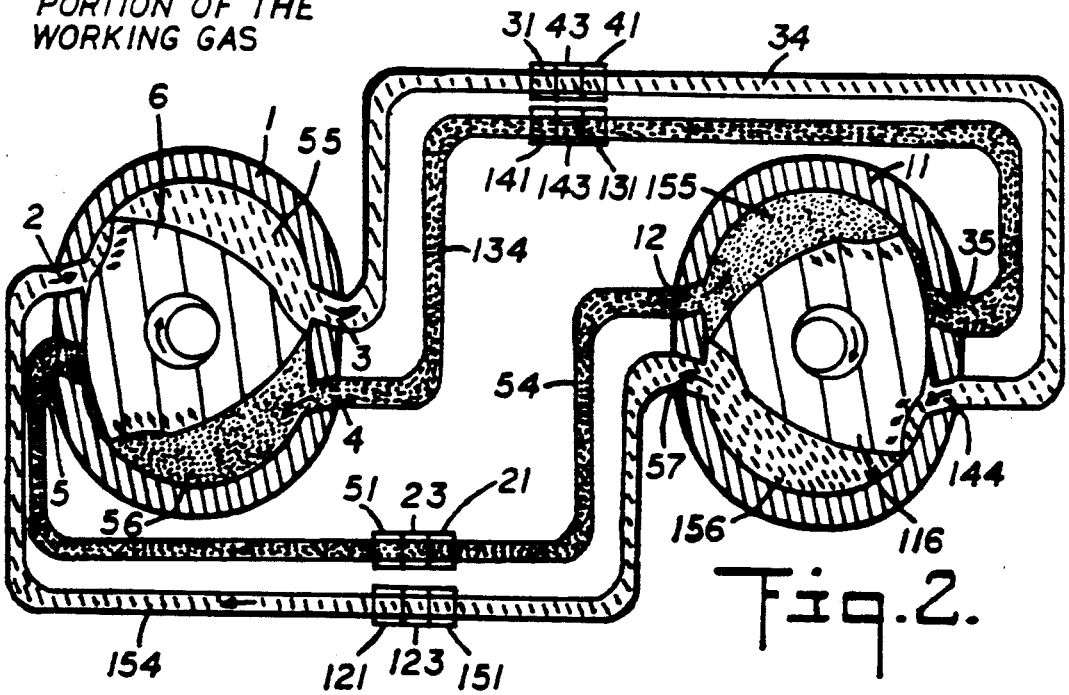
Fig. 2.
FIRST PORTION OF THE WORKING GAS Fig. 3.
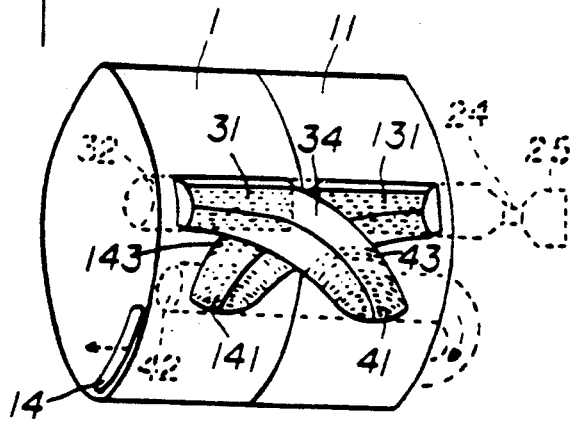
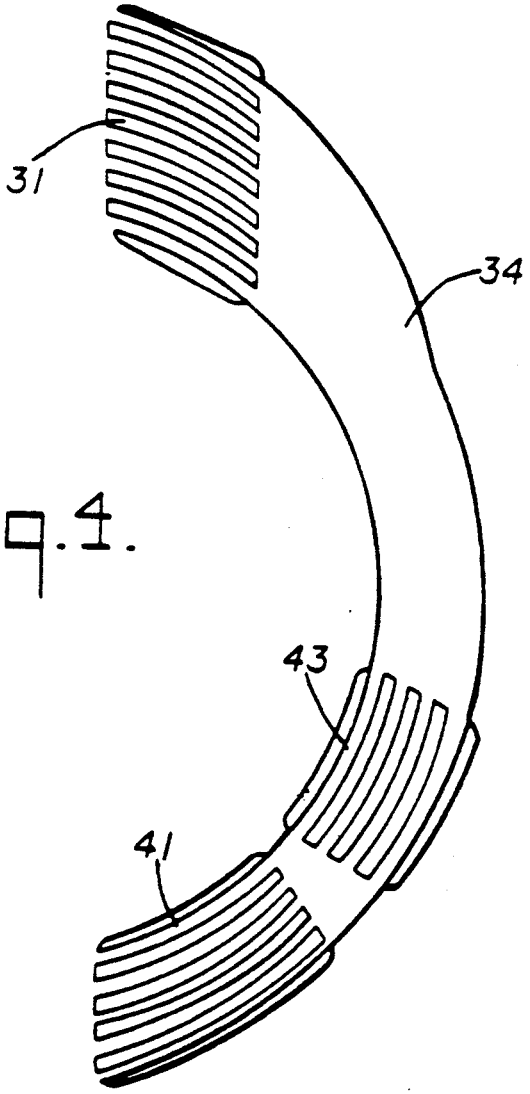
Fig. 4.

Fig. 7.
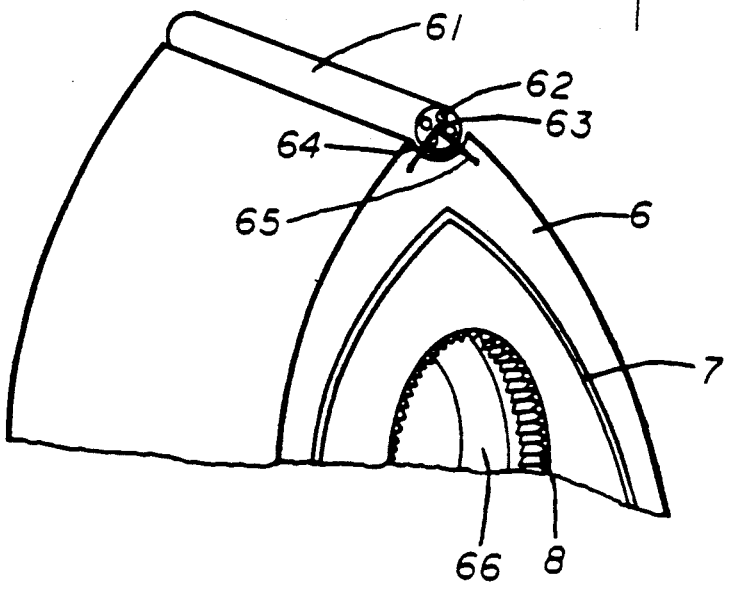
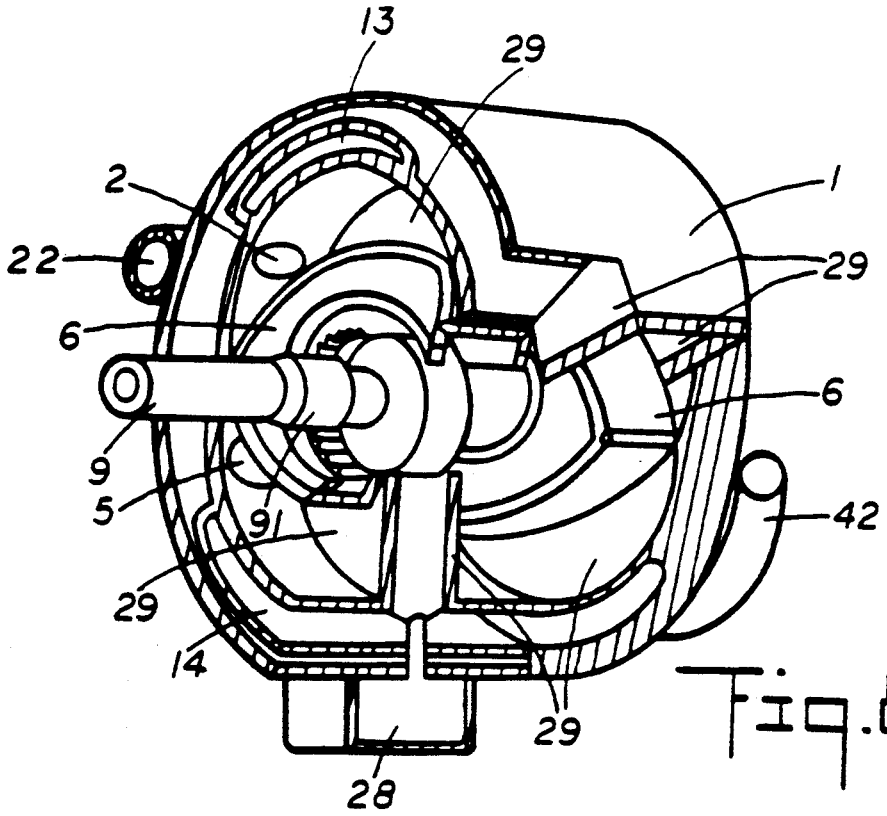
Fig. 8.

Fig. 13 A.
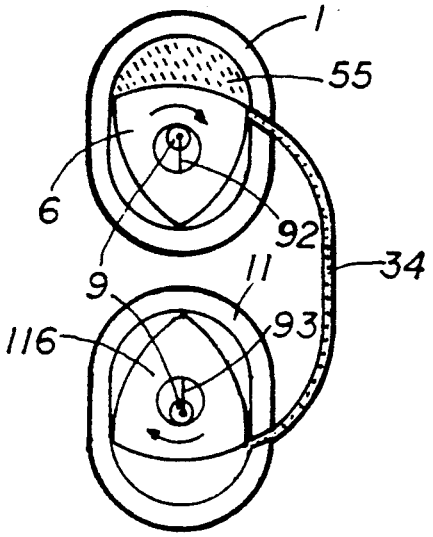
Fig. 13 B.
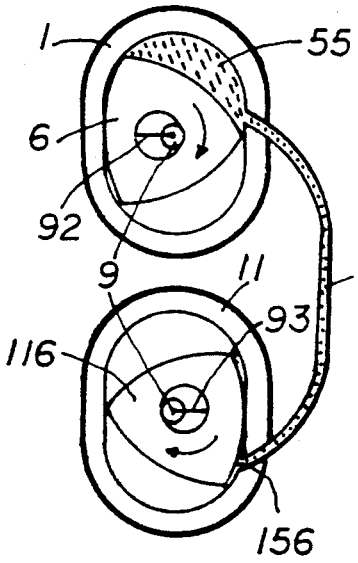
Fig. 13 D.
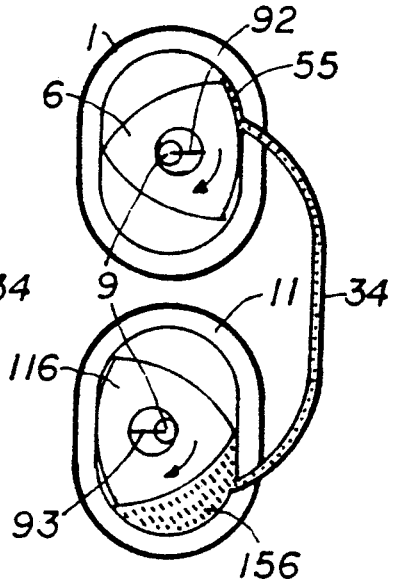
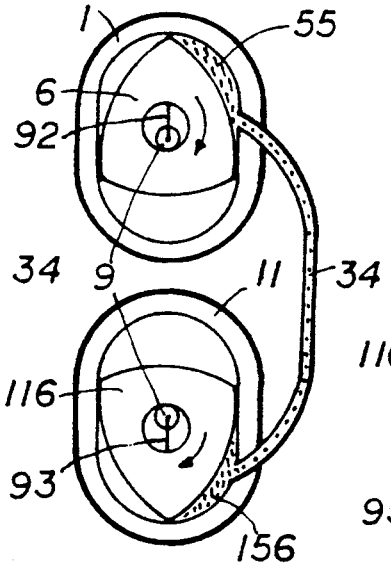
Fig. 13 C.

Fig. 14A.
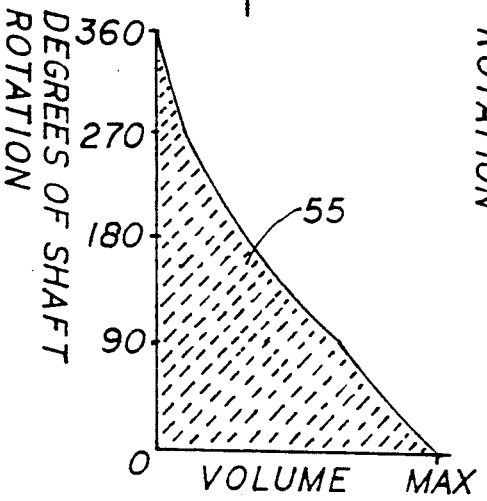
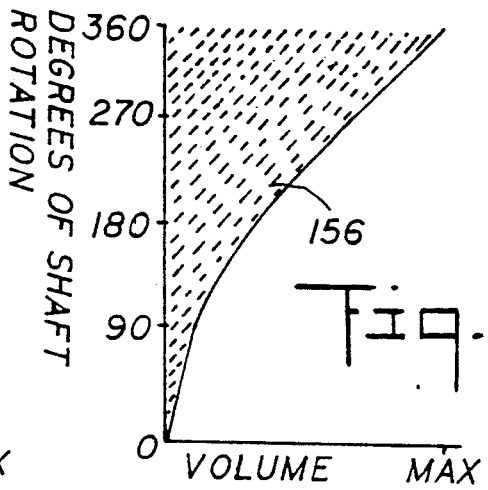
Fig. 14B
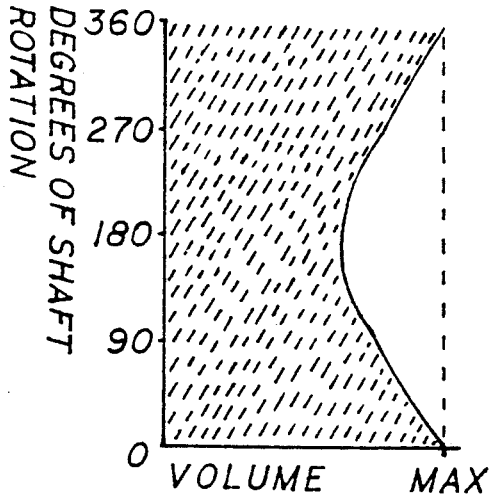
Fig. 14C.

EXTERNAL COMBUSTION ROTARY ENGINE

This application is a continuation-in-part of U.S. application Ser. No. 07/585,291, filed Sep. 19, 1990 and entitled "External Combustion Rotary Engine", now abandoned. The present invention relates to the rotary (Wankel) engine, Stirling cycle engines, cooling (air-conditioning) systems which use refrigerant fluid, and steam turbines.

BACKGROUND OF THE INVENTION

Rotary engines and Stirling engines have been known for a long period of time. However, they were not applied on a very wide basis despite the fact that they provide some very significant advantages in comparison to other internal combustion engines.

The rotary (Wankel) engine has been applied as a power plant in a relatively small numbers despite its very favorable power to volume ratio and relative simplicity. Current emission standards and growing concerns about environmental pollution further decrease prospects for this type of engine which produces very low inertia, centrifugal, and friction loses.

On the other hand, Stirling cycle engines enable a clean combustion but have very unfavorable power to volume ratio. A Stirling engine which applies double-acting pistons and swash plate can operate at 3,000 rpm with an efficiency of 30% which is as good as most internal combustion engines. This engine is very easy to start, clean, quiet in operation, and relatively simple in basic design but relatively unsuitable for use as a vehicle's power plant.

Consequently, due to their drawbacks both types of engines do not seem to have a promising future as vehicle's power plant. Therefore, it is an object of the present invention to provide an hybrid engine which will eliminate drawbacks of both rotary and Stirling engines and use their advantages to provide an environmentally clean, fuel-efficient, quiet, compact, and relatively simple engine.

SUMMARY OF THE INVENTION

The present invention provides an engine wherein a triangular rotor rotates inside a housing in the form of an Epitrochoid curve. The rotor fits on an eccentric shaft and its internal gear meshes with a stationary-gear which is mounted in a side housing. Consequently, a rotating motion of the rotor causes the eccentric shaft to rotate while the stationary gear keeps the rotor moving in proper (eccentrical) path.

The housing is provided with two inlet and two outlet ports which are located inside two opposite (longitudinal) sides of the housing. The two sides of the rotor are enclosed by two flat-faced side housings. Two heater tubes are provided along the inlet ports and they intersect with manifolds which contain heat exchangers (heaters). The heat exchangers (coolers) are provided next to outlet ports inside manifolds which extend from inlet to outlet ports. Two burners are provided for purpose of burning air-fuel mixture and delivering heat to the heaters. A cooling system is also provided for purpose of cooling working gas which is contained in two sealed systems each consisting of two manifolds, two expansion chambers, two heaters, and two coolers.

The preferred embodiment requires an even number of the housings and rotors in order to operate with maximum efficiency. In this embodiment, one outlet port of the first housing is connected by the manifold to the one inlet port of the second housing and vice versa. Accordingly, two outlet ports from the first housing are connected to two inlet ports of the second housing and vice versa. The process also requires two rotors to work in concert with each other in such a manner where the first rotor supplies the working gas to the second rotor and vice versa. According to the process of the present invention, the working gas (such as helium) is selectively heated and cooled in order to produce useful work. When the working gas passes through the heater and enters into the housing through the inlet port, it expands (its pressure raises) and produces power thrust on the rotor lobe. This causes the rotor to turn and produce a torque on the eccentric shaft. As the rotor turns, its lobe uncovers the outlet port which leads into the manifold. The cooler is provided inside the manifold next to the outlet port which causes the outlet port to act as a low pressure zone. As soon as the working gas enters the cooler it contracts (its pressure decreases) and its volume significantly decreases.

The working gas which is pushed (compressed) from one housing flows through the cooler and manifold and enters into the preheater and heater located in front of the inlet port of the second housing. The process is continued inside the second housing where the heated and expanded working gas exerts the pressure on the rotor lobe inside the newly forming expansion chamber. Since the rotor spins eccentrically, it alternately forms the expansion chambers, one below the top of the housing and one above the bottom of the housing.

The surplus of work is produced because of a pressure difference of the working gas. Namely, as the working gas flows through the heaters, it expands and produces a power thrust against the rotor lobe. The pressure of the heated gas significantly exceeds the force required to overcome resistance of the same amount of the cooled and contracted working gas. While compressed through the coolers and manifolds, the cooled and contracted working gas does not create any significant resistance which would significantly oppose the force created by the heated and expanded working gas.

The present invention also comprises two fuel burning sections further comprising air inlets and burning chambers (burners). The burners are manufactured in a manner which provides for the best utilization of heat and does not produce harmful emissions. Since there is no significant compression of air-fuel mixture and enough air is provided to form an ideal mixture, there will be no pollutants produced during the burning process. The continuous burning will also be completely quiet and will not cause any vibration.

As proposed for the preferred embodiment, the cooling system comprises two sealed systems where a certain predetermined amount of refrigerant fluid is alternately compressed and evaporated for purpose of absorbing the heat from the working gas inside the coolers and discharging the heat into the preheaters.

It is also an object of the present invention to provide an engine having a slightly different embodiment wherein a turbine is mounted on a rear end of the eccentric shaft. In this embodiment, rejected heat will be absorbed inside the coolers by water which is circulated through a radiator and excessive heat which cannot be absorbed by the working gas inside the heaters will be used to power the turbine. Consequently, this amount of excessive heat which will otherwise be lost in exhaust gases will also be used productively. The turbine will exert the power on the shaft in situations when the power exerted by the rotors does not provide for required acceleration.

As obvious from the above, both embodiments of the present invention will provide a very cost-efficient, very energy-efficient, compact, vibration free, and quiet engine. It will be relatively simple to manufacture and maintain, and will produce minimum amount of harmful emissions. It will not require valve trains and valves, sophisticated ignition and fuel injection systems, pistons, connecting rods, an emission control system and sophisticated lubrication system.

Hence, the manufacturing costs will be very low in comparison to the existing internal combustion engines. This engine will require much less maintenance and service because the possibility of any break-down is at minimum. Because of superior burning conditions, the possibility for much better utilization of energy in fuel, much lower friction, inertia, and centrifugal losses, and flat torque curve this engine will deliver much higher power output per unit of energy output.

The features and advantages of the present invention will become apparent from the following brief description of drawings and description of the preferred embodiments.

BRIEF DESCRIPTION OF THE DRAWINGS

FIG. 1 is the cutaway view of the housing, the rotor, and the shaft according to the present invention;

FIG. 2 is the cutaway view of two housings and rotors showing the position of the rotors at an instant during their rotation;

FIG. 3 is the perspective view of the housings showing positions of the heaters, manifolds, preheaters, and coolers located on the right had side of the housing;

FIG. 4 is the cutaway view of one transfer manifold showing the arrangement of the cooler, preheater, and heater;

FIG. 7 is the perspective view of one rotor apex showing the position of the rolling cylinder;

FIG. 8 is the perspective cutaway view of the two-rotor engine;

FIG. 13A is a schematic view of two rotors showing the compression process of the working gas at 0 degrees shaft rotation.

FIG. 13B is a schematic view of two rotors showing the compression process of the working gas at 90 degrees shaft rotation.

FIG. 13C is a schematic view of two rotors showing the compression process of the working gas at 180 degrees shaft rotation.

FIG. 13D is a schematic view of two rotors showing the compression process of the working gas at 270 degrees shaft rotation.

FIG. 14A is a graph showing the volume of compressed gas as a function of shaft rotation.

FIG. 14B is a graph showing the volume of expanded gas as a function of shaft rotation.

FIG. 14C is a graph showing total gas volume as a function of shaft rotation.

DETAILED DESCRIPTION OF THE PREFERRED EMBODIMENT

Figure 5:
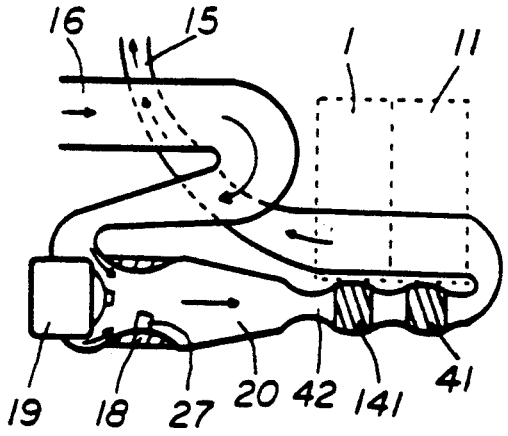
FIG. 5 is the schematic view of one burning section.
Figure 5A:
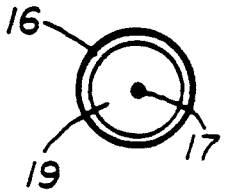
FIG. 5A is the view of the fuel atomizer observed from the burning chamber.

As shown on FIGS. 2, 3 and 8, the present invention comprises an even number of housing 1 wherein rotors 6 and 116 are enclosed as shown on FIGS. 1, 2 and 8. As shown on FIG. 1, the triangular rotor 6 is enclosed inside the housing 1 and its internal gear 8 meshes with a stationary gear 10 installed in a side housing 29 shown on FIG. 8. This causes the rotor 6 to rotate eccentrically around the stationary gear 10 and follow an orbit that keeps all three apex bearings 61 in the sliding contact with the housing 1. This rotary motion of the rotor 6 creates one expansion chamber 55 inside the upper housing and one expansion chamber 56 inside the lower housing.

The rotor 6 transmits the force developed by the hot and expanded working gas to an eccentric shaft 9 which fits inside the rotor's bearing 66 shown on FIG. 7. The rotor 6 rotates and its action causes the shaft 9 to rotate three times while the rotor 6 turns only once. Accordingly, if the rotor 6 spins at a rate of 3,000 rpm, the shaft 9 spins at a rate of 9,000 rpm. The eccentric shaft 9 is supported by main bearings installed inside the side housing 29.

The housing 1 comprises two inlet ports 2 and 4, and two outlet ports 3 and 5, as shown on FIGS. 1 and 8. Each inlet port 2 and 4 is connected to the corresponding heater (heat exchanger) which are located on the outer side of the housing 1. Each outlet port 3 and 5 is connected to the corresponding cooler which are also located outside the housing 1.

As for the preferred embodiment, the present invention requires an even number of the housings 1 and the rotors 6 where the outlet port 3 of the first housing is connected by the manifold 34 to the inlet port 144 of the second housing, as shown on FIGS. 2 and 3. Also, the outlet port 5 of the first housing is connected to the inlet port 12 of the second housing by the manifold 54 as shown on FIG. 2. The outlet ports 35 and 57 of the second housing are also connected to the inlet ports 4 and 2 of the first housing by the manifolds 134 and 154 also shown on FIG. 2.

Both rotors 6 are supposed to work in concert with each other to maintain proper displacement of the working gas from one expansion chamber 55 to another expansion chamber 156 and vice versa. The working gas is also displaced from the expansion chamber 56 to the expansion chamber 155 and vice versa. As shown in FIGS. 3 and 5, two heating tubes 22 and 42 are provided along the housings 1 next to the inlet ports 2, 4, 12, and 144. These tubes are connected on two burning units, as shown on FIG. 5, which provide hot gases for purpose of heating the working gas inside the heaters 21, 121, 41, and 141. The burner units comprise air inlet manifolds 16, fuel atomizers 19, preheaters 18, igniters 27, and burning chambers 20. The burner units are located on both sides of the housings 1 and 11 and adjacent to corresponding heating tube 22 and 42.

Figure 6:
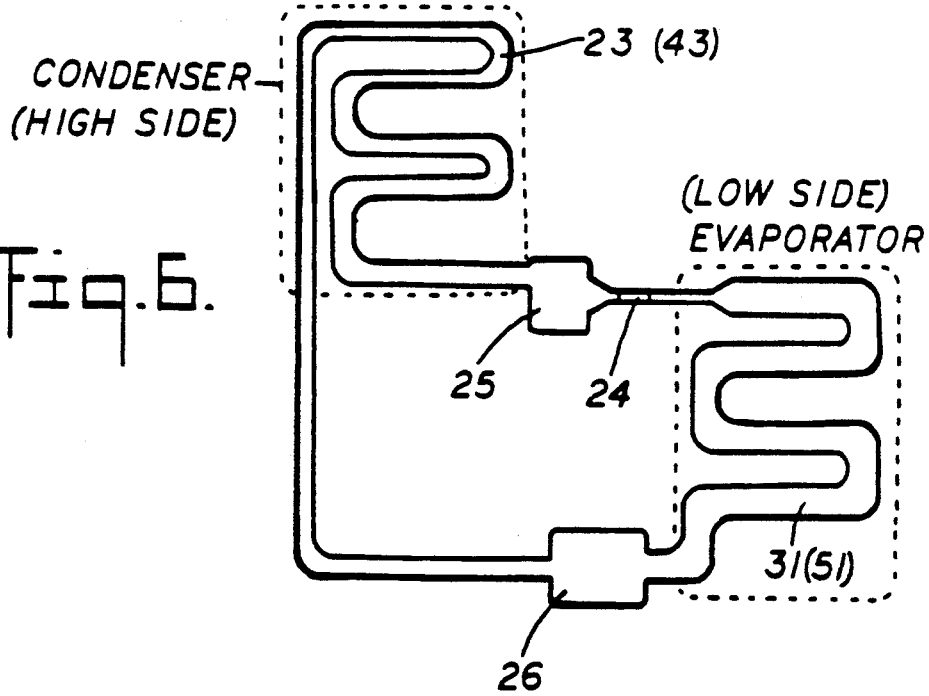
FIG. 6 is the schematic view of one cooling system.

As shown on FIG. 6, a cooling system comprises two units both comprising a cooling coil (evaporator) 31 or 51, a compressor 26, a condenser coil (preheaters) 23 or 43, and a receiver 25 with a throttle valve 24. The cooling units contain a refrigerant fluid which constantly circulates in a closed path from the compressor 26 to the preheaters 23 and 43, receiver 25, and further through throttle valve 24 into the coolers 31 or 51, and back to the compressor 26. The refrigerant fluid permanently changes from a liquid state to a gas state which enables the heat absorbed from hot gases to be discharged through the condensers 23 or 43 (preheaters) back to the working gas. This action will permanently cool the working gas inside the coolers 31 and 51 and heat the working gas inside the preheaters 23 and 43.

It is to be understood that the engine of the present invention does not necessarily require two burning units and two cooling units. Depending on number of the housings and rotors, and requirements regarding power output and efficiency, this engine may apply only one burning unit and only one cooling unit.

Since the engine of the present invention will not produce severe combustion and related shocks, most of its integral parts can be manufactured of lightweight materials which will result in an extremely lightweight engine. According to the process of the present invention, the pushing force will be exerted on each rotor six times within a single rotation which equals four times for a single crank rotation. This will provide for extremely smooth process and excellent power dispersion.

According to the process of the present invention, outside air enters the air inlet manifold 16 and flows into the burning chamber 20. The burning process is started when the electrically operated preheater 18, shown on FIG. 5, raises the temperature of the air trapped inside the burning chamber 20 above the flash point of fuel which may be gasoline, kerosene, oil, or some other suitable fuel or gas. The fuel is sprayed from the fuel atomizer and air-fuel mixture is ignited by the igniter 27. The increased pressure inside the burning chamber 20 forces burned gases to flow through the heating tubes 22 or 42, heating holes 13 or 14, and exhaust pipe 15. A physical configuration of the burning chamber 20 and related passages should allow an uninterrupted flow of the burned gases, or some other means (such as a fan inside the air inlet manifold) can be used for controlling this flow. The physical configuration and process will mainly depend on the type of fuel and its burning characteristics.

As air-fuel mixture burns, it develops heat and pressure which forces hot burned gases into the heater tubes 22 or 42. The gases flow through the heater tubes 22 or 42, shown on FIGS. 5 and 8, and pass through the heaters 41, 141, 21, and 121 where a certain amount of the heat is absorbed by the two portions of the working gas. Consequently, the working gas pressure inside the heaters 41, 141, 21, and 121 is increased which causes the pressure inside the inlet ports 2, 4, 12, and 144 to increase.

After passing through the heaters, the burned gases are redirected into the heater holes 13 and 14 which extend through the housing 1 next to the expansion chambers 55, 56, 155 and 156. The process will enable the energy which remains in the burned gases after passing through the heaters to be converted into useful work. After leaving the heating hole 13 or 14, the burned gases enter the tube which extends through the air inlet manifold 16, as shown on FIG. 5. This will enable the remaining heat in the burned gases to be absorbed by fresh incoming air and increase its temperature. Consequently, the temperature of the exhaust gases will be kept a minimum and the temperature of the incoming air will be raised above the flash point required for permanent and the most effective burning process.

It is to be understood that a rotating regenerator (heat exchanger) or some other suitable means can be used for the purpose of a heat transfer from exhaust gases to incoming air. As obvious from above description, the burning and heat discharging process will produce almost no harmful emissions and will enable maximum possible utilization of the heat developed by burning air-fuel mixture. It is assumed that the entire process from air inlet to exhaust can be controlled by electronic control unit which responds according to sensed engine conditions. However, since there are no valves and sophisticated fuel injection and ignition systems applied, the process will require controlling of air intake and fuel atomizing only.

In the case of gasoline, the combustion will happen under almost ideal conditions and will form harmless $H_2O$ and $CO_2$. Atomized gasoline mixed with enough air will result in chemically correct mixture and conditions for HC and CO formation will not exist. Also, since the combustion will not produce extremely high temperatures, NOx will not be formed.

As mentioned before, the cooling system comprises two independent cooling units, each cooling the working gas inside the coolers 31, 131, 51 and 151 along one side of the engine and providing the heat to the preheaters 23,123,43 and 143 along one side of the engine. Each cooling unit comprises the receiver (refrigerant reservoir) 25, the throttle valve 24, the evaporator, the compressor 26, and the condenser. The receiver 25 and the compressor 26, are located on the opposite sides of the engine. The refrigerant fluid is released from the receiver 25 through the throttle valve 24 into the evaporator which extends through the cooling tubes 32 or 52. Because of the low pressure in the evaporator, the boiling point of the refrigerant falls and produces a heat-absorbing reaction which cools the working gas inside the coolers 31, 131, 51 and 151. At the end of the tube 32 or 52, the refrigerant (now in vapor form) flows into the compressor 26 which compresses the gas to a high pressure and pumps it into the condenser. The condenser extends through the preheaters 23, 123, 43 and 143. Because of the high pressure in the condenser, the boiling (condensing) point of the refrigerant is raised and the refrigerant condenses back into a liquid. In this process of condensing, the refrigerant discharges the heat absorbed from the working gas inside the coolers 31, 131, 51 and 151. The discharged heat is absorbed by the working gas inside the preheaters 23, 123, 43 and 143 and liquid refrigerant flows back to the receiver 25.

The above described process enables permanent cooling of the working gas inside the coolers 31, 131, 51 and 151 and permanent heating of the working gas inside the preheaters 23, 123, 43 and 143. This will enable maximum possible utilization of heat which remains in the working gas after leaving the expansion chamber 55 or 56. The compressors 26 can be powered from the eccentric shaft and their process can be controlled by the engine's electronic control unit or a thermostat with a heat sensor inside the coolers 31, 131, 51 and 151. The compressors also can be powered by their own electric motors, if proven more effective for the purpose of the invention.

In the case that air cooling system is applied for purpose of cooling the working gas, the system will require a turbine which will force outside air through the cooling tubes 32 and 52. The air which passes through the coolers 31, 131, 51 and 151 can be redirected through tubes which house the preheaters 23,123, 43 and 143. This will enable a portion of the heat absorbed inside the coolers 31, 131, 51 and 151 to be again absorbed by the working gas inside the preheaters 23, 123, 43 and 143.

According to the process of the present invention, a certain amount of working gas (such as helium) is enclosed inside the sealed path where it permanently circulates from one expansion chamber 55 to another 56. In the case of two rotors, one portion of the working gas circulates through the following path. From the expansion chamber 55 of the first housing i the working gas flows into the cooler 31 and further through the transfer manifold 34 into the preheater 43 and the heater 41 which are located next to the second housing 11. After leaving the heater 41, the working gas enters the expansion chamber 156 inside the second housing 11 and flows to the cooler 151 which is located on the opposite side of the housing. From the cooler 151 of the second housing 11, the gas flows through the manifold 154 into the preheater 123 and the heater 121 located next to the first housing 1 and enters the expansion chamber 55 in the first housing 1.

The second portion of the working gas flows from the expansion chamber 155 in the second housing 11 through the cooler 131 and manifold 1324 into the preheater 143 and the heater 141 located next to the expansion chamber 56 of the first housing 1. This working gas further flows through the expansion chamber 56 in the first housing 1, corresponding cooler 51, and manifold 54 which intersects with the preheater 23 and the heater 21 located next to the expansion chamber 155 in the second housing 11. As obvious from the above description, both portions of the working gas circulate through two expansion chambers either 55 and 156 or 155 and 56 while flowing from one housing to another. The transfer manifolds 34 and 134 which intersect with the cooling 32 and heating 42 tubes and house the coolers 31 and 131, the preheaters 43 and 143, and the heaters 41 and 141 are positioned on the right had side of the engine as shown on FIG. 3. On the opposite side of the engine (left hand side) the manifolds 54 and 154 are positioned in the opposite manner.

The further description of the power producing process starts with the assumption that the rotor 6 and rotor 116 are positioned as shown on FIG. 2. It is also assumed that at this instant the temperature and pressure of the working gas is equal inside the expansion chambers, the heaters, the coolers, and the manifolds, and that engine does not have any starter which is operated from some outside energy source. It is assumed that this engine does not necessarily require any starter but it is to be understood that a starter can be provided, if proven effective for purpose of producing a primary acceleration of the rotors 6 and 116.

As the burned hot gases start to circulate through the heaters 121, 21, 141 and 41 and the heating holes 13 and 14, the working gas inside the heaters 21, 121, 41 and 141 and the expansion chambers 55,155,56 and 156 starts absorbing the heat and its pressure increases. Consequently, the working gas pressure inside the expansion chamber 56 and the area next to the inlet port 2 in the first housing 1 starts to raise and exceed the pressure of the working gas inside the expansion chamber 55 and the area next to the outlet port 5. The heat absorbed by the working gas inside the second housing 11 produces the same effect inside the expansion chamber 155 and the area next to the inlet port 144 of the second housing 11. Since the center line of maximum shaft eccentricity in both housings 1 and 11 always enables the pressure of the heated working gas to efficiently push against the rotors' 6 and 116 lobes, the rotors 6 and 116 will start to rotate.

As soon as the rotor 6 inside the first housing 1 starts to rotate, it will start displacing the working gas from the expansion chamber 55 in this housing through the cooler 31 and manifold 34 which leads to the second housing 11. As the working gas flows through the heater 41 in front of the inlet port 144 in the second housing its pressure increases and exerts the pushing force against the rotor's 116 lobe. Simultaneously, the cool working gas from the expansion chamber 156 in the second housing 11 is pushed by the rotor 116 through the cooler 151 and manifold 154 into the heater 121 in front of the inlet port 2 in the first housing 1. The pressure of this gas is also increased and it exerts the pushing force against the rotor's 6 lobe inside the expansion chamber 55 which starts to form in the first housing 1.

The working gas from the area next to the outlet port 5 in the first housing 1 is displaced into the expansion chamber 155 in the second housing 11 and the working gas from the area next to the outlet port 35 of the second housing 11 is displaced into the expansion chamber 56 in the first housing 1. As rotors 6 and 116 spin, the areas next tot he inlet port 2 in the first housing 1 and the area next to the inlet port 144 in the second housing 11 are increasing in volume and forming the expansion chambers. The existing expansion chambers, the chamber 55 inside the first housing 1 and the chamber 155 inside the second housing 11 are approaching their maximum volume.

The pushing force of the working gases is permanently exerted against two rotor's lobes which are positioned toward the side of the maximum shaft eccentricity. Since the maximum shaft eccentricities change their position three times faster than the rotors 6 and 116, the position of the inlet 2, 4, 12 and 144 and outlet 3, 5, 35 and 57 ports enables the continuous pushing force to be exerted on the lobes which are positioned at the point which provides for the strongest possible resultant force at a certain instant. For example, when the hot working gas starts entering into the first housing 1 through the inlet port 2, the maximum eccentricity line points towards the middle of the left longitudinal wall of the housing 1. At this instant, the lobe which just uncovered the inlet port 2 is about 45 degrees in advance of the maximum eccentricity line and the hot gas inside the expansion chamber 56 still exerts the force against the lobe which approaches the outlet port 5. Since for each degree of the rotor's 6 rotation the maximum eccentricity line advances by 3 degrees, this line will be pointing towards the middle of the right longitudinal wall of the housing at the instant when the rotor 6 reaches the position shown for the rotor 116 on FIG. 2.

During this 90 degrees travel of the maximum eccentricity line the rotor 6 will travel from the first position shown on FIG. 2 (rotor I) to the second position shown for the rotor 116 on FIG. 2. As obvious, during this period of the rotor's 6 rotation, the hot gases inside the expansion chamber 56 will push the rotor 6 but, due to the heat absorption process and change in position of the maximum eccentricity line, the force exerted by this gas will decrease. This will be compensated by the increase of the force exerted by the gas entering through the inlet port 2 because this force will be increasing. When the force exerted by the gas entering through the inlet port 2 starts to decrease, the force exerted by the gas now entering through the inlet port 4 will compensate for this decrease. Consequently, the same amount of force will be applied on the rotor 6 during entire 360 degree rotation which will result in a completely vibrationless engine and provide for minimum centrifugal and inertia losses.

When the working gas warms up and the rotors 6 and 116 start to rotate, the cooling units are activated and the compressors 26 start to compress the refrigerant fluid. The hot gas inside the expansion chamber 55 in the first housing 1 pushes against the rotor's 6 lobe and as soon as the rotor's 6 lobe starts uncovering the outlet port 3 the expanded hot gas starts streaming inside this port 3. The outlet port 3 represents a low pressure area which causes the flow of the hot gas inside this port 3. The hot expanded gas streams into the cooler 31 where the major portion of the heat in this gas is absorbed by the refrigerant gas. Consequently, the pressure of the working gas dramatically drops and it continues to flow through the manifold 34. As soon as the rotor's motion starts decreasing the volume of the expansion chamber, it starts compressing the hot working gas inside the outlet port 3. This action continues up to the point when entire amount of the working gas is displaced from the expansion chamber 55.

After passing through the cooler 31, the cooled working gas flows through the manifold 34 and enters the preheater 43 where it absorbs the heat from the condensed refrigerant fluid. The pressure of the working gas increases again and it continues to flow towards the heater 41 where it again absorbs more heat from the burned hot gases which circulate through the heater 41. When the working gas passes through the heater 41 its temperature and pressure are significantly increased. Therefore, when this gas enters the second housing through the inlet prot 144, it exerts the pushing force on the rotor's lobe now located in front of this port 144. The force exerted by the hot and expanded working gas forces the rotor 6 to continue its rotation.

As the rotor 6 spins, its rotation increases the volume of the expansion chamber 156 which is filled with a larger and larger amount of the hot working gas. This increases the amount of the pushing force which is exerted on the rotor's 116 lobe. The temperature and pressure of the working gas inside the expansion chamber 156 is also increased due to the heat absorbed from the heating hole 14 through the housing wall which separates the heating hole 14 and the expansion chamber 156. The heat absorbed from the burned gases which flow through the heating hole 14 will further increase the pushing force exerted on the rotor's lobe.

When the rotor's lobe uncovers the outlet port 57 in this (second) housing the hot expanded working gas starts streaming into this port 57. The subsequent heat discharging inside the cooler 151 and the heat absorbing inside the preheater 123 and heater 121 corresponds to the above described process. The working gas displacement from the expansion chamber 156 through the manifold 154 into the inlet port 2 of the first housing 1 also corresponds to the above description. Accordingly, this portion of the working gas is circulated from the expansion chamber 55 of the first housing 1 through the manifold 34 to the expansion chamber 156 of the second housing 11 and further through the manifold 154 back into the expansion chamber 55 of the first housing 1.

The second portion of the working gas is circulated from the expansion chamber 56 of the first housing through the manifold 54 to the expansion chamber 155 of the second housing 11 and further through the manifold 134 back into the expansion chamber 56 of the first housing 1. Since both rotors 6 and 116 work in concert with each other, the working gas displacement from each expansion chamber, the cooling and heating process of the working gas inside each manifold, and the formation of each expansion chamber are performed identically. The circulation of both portions of the working gas is permanent and the power producing process is uninterrupted and completely uniform.

FIGS. 13A–D schematically illustrate the compression process. The volume of the compressed and expanded gas and the total gas volume during shaft rotation is graphically depicted in FIGS. 14A–C. The process begins with the rotors 6 and 116 positions as shown in FIG. 13A wherein the maximum eccentricity lines 92 and 93 of both rotors 6 and 116 point in opposite directions and wherein the upper expansion chamber 55 in the first housing 1 is at its maximum volume as shown in FIG. 14A. This situation shown in FIG. 13A represents 0 degrees of shaft rotation having volumes as shown in FIGS. 14A–C. When the maximum eccentricity lines 92 and 93 on the eccentric shaft 9 move for 90 degrees, to the position shown in FIG. 13B, the Volume of the expansion chamber 55 decreases at a much higher rate than the increase of volume of the expansion chamber 156. Consequently, the working gas is compressed at the rate as shown in FIGS. 14A–C.

Another 90 degrees of shaft rotation (from 90 to 180 degrees of shaft rotation) causes further compression of the working gas due to faster decrease of the expansion chamber's 55 volume with respect to increase of the expansion chamber's 156 volume as shown in FIGS. 14A–C. At the point shown in FIG. 13C which represents 180 degrees of shaft rotation, the total volume of the working gas is at its minimum. The degree of compression decreases for the next 90 degrees but, as shown in FIGS. 14A–C, a significant compression still exists at the point which represents 270 degrees of shaft rotation shown in FIG. 13D. Towards the point shown in FIG. 13A when the shaft 9 completes its 360 degrees of rotation (same position as shown for the 0 degrees of shaft rotation) the compression further decreases and the working gas volume reaches its maximum again as shown in FIGS. 14A–C.

Since exactly the same process happens during every displacement of the working as, this description is applicable for the entire process regardless from which chamber the working gas is displaced. Also, the working gas compression always coincides with the favorable positions of the eccentricity lines 92 and 93. In this case, this position refers to positions shown in FIGS. 13A–D for the rotors 6 and 116 from 90 degrees of the shaft rotation to 270 degrees of the shaft rotation.

According to the process of the present invention, each apex of the rotor's 6 lobes is permanently in sliding contact with the inner wall of the housing 1. Since there is no possibility to provide oil lubrication which will reduce the friction between the rotor 6 lobes' apexes and the housing 1 wall, it is the proposal of the present invention to provide each apex with a roller bearing mounted inside a grove. As shown on FIG. 7, the roller bearing 61, 62 and 63 is mounted inside the grove 64 and fastened to the rotor 6 by the bearing holder 65. The roller bearing comprises an inner shaft 63, a plurality of rollers 62, and a rolling cylinder 61. The rollers 62 are inserted between the inner shaft 63 and rolling cylinder 61 which is sealed on both sides. The rolling cylinder is filled with a permanent lubricant which lubricates the rollers 62 and decreases their friction against the cylinder 61 and the inner shaft 63.

The inner shaft 63 slightly extends outside the rolling cylinder 61 and its outer edges fit inside the bearing holder 65 which is mounted on the flat rotor's wall. The bearing holder 65 is fastened to the rotor's wall in the manner which will result in a permanent outward thrust on the roller bearing. Accordingly, when the rotor 6 is inserted into the housing the roller bearings will press against the inner housing wall and a slight clearance between the grove 64 and the rolling cylinder 61 will exist. During the rotor 6 motion a very small and insignificant amount of the working gas will be able to escape through the clearance between the rolling cylinder 11 and the grove 64 and through the clearance on both sides of the rolling cylinder but this will not influence the engine performance at all. Namely, the side seal 7 will contain this working gas and will prevent it from leaking inside the inner rotor opening.

The side seal 7 is provided around both side walls of the rotor, as shown on FIGS. 1 and 7. The purpose of this seal is both to contain the working gas inside the expansion chambers and to contain the lubricating oil inside the inner opening of the rotor 6. The lubricating oil is supplied by the oil pump through the hollow eccentric shaft for purpose of lubricating the bearings 66 and 91 and gears 8 and 10. This oil then drops down from the bearings 66 and 91 and gears 8 and 10 and returns to the oil pan 28 at the bottom of the engine, FIG. 8. Since the rotor 6 rotates eccentrically, and its side seal 7 permanently changes its position, the lubricating oil will also lubricate the major portion of the flat-faced side housings 29 and the flat side walls of the rotor 6 but will not be able to escape inside the expansion chambers 11 and 12.

As known from the prior art, a Stirling cycle engine can be designed to use either air, hydrogen, helium, freon, or nitrogen. Since air and nitrogen appear to be limited to 20–25% of the power of a helium or hydrogen filled engine of the same displacement, helium and hydrogen are accepted as a better choice. Despite its excellent properties, such as the highest thermal conductivity and the lowest viscosity, hydrogen does not seem to be the best solution because it permeates through metals and is flammable. Therefore, helium, which has a viscosity twice that of hydrogen but can be permanently contained and has a thermal conductivity which is nearly as good as hydrogen, is widely accepted as the best choice in this type of engine. It is thus believed that helium is the best choice for a working gas in the engine of the present invention. Since the present invention enables relatively unrestricted flow, the choice of relatively inert helium will not result in any significant energy loss.

Figure 9:
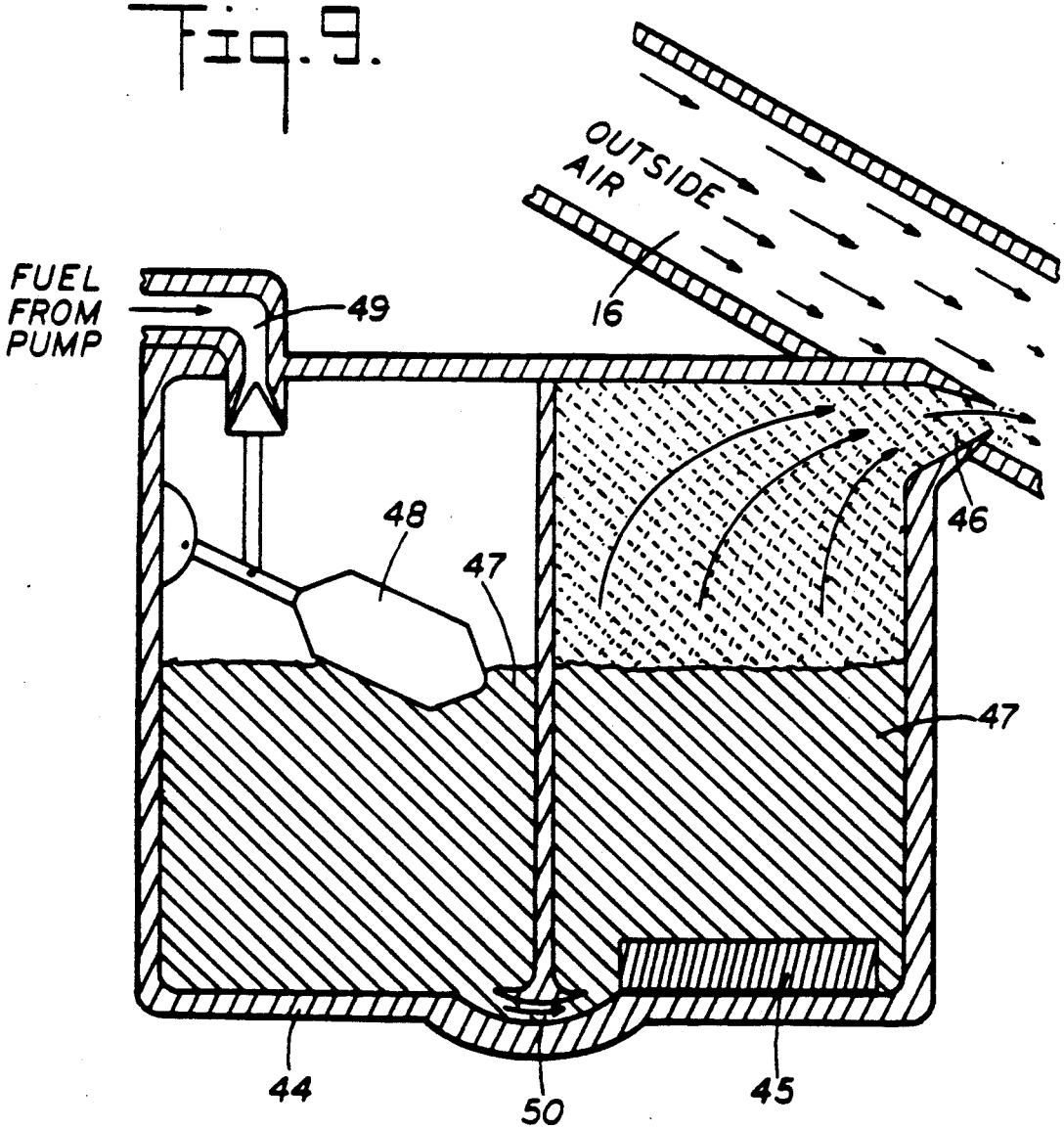
FIG. 9 is the cutaway view of the ultrasonic fuel atomizer.

Bearing in mind that any kind of classical fuel atomizer 19 can be used in the present invention, it is the proposal of the present invention to apply an ultrasonic fuel atomizer for purpose of atomizing a fuel in the present invention. Such ultrasonic fuel atomizer, shown on FIG. 9, comprises two chambers, the fuel storing chamber and fuel atomizing chamber which are connected by the passage 50. The fuel 47 is supplied through the inlet valve 49 and its flow is controlled by the float 48 which opens and closes the inlet needle valve 49 according to the fuel level inside the storing chamber. The fuel (gasoline) flows inside the atomizing chamber and fills it to the level permitted by the action of the float 48.

The fuel atomizing chamber is provided with an ultrasonic transducer 45 which is located on the bottom of this chamber. The transducer 45 act on the fuel above and produce atomized vapor which flows towards the outlet port 46. The outlet port 46 extends inside the air inlet manifold where the atomized fuel mixes with incoming air creating an air fuel mixture. Since this ultrasonic atomization of fuel will produce the best possible vapor, the burning conditions of the air fuel mixture will reach the best possible extent and result in superb utilization of energy in fuel and no pollutants released into the atmosphere. It is to be mentioned that the process of the ultrasonic transducer is controlled by controlling voltage input.

Figure 10:
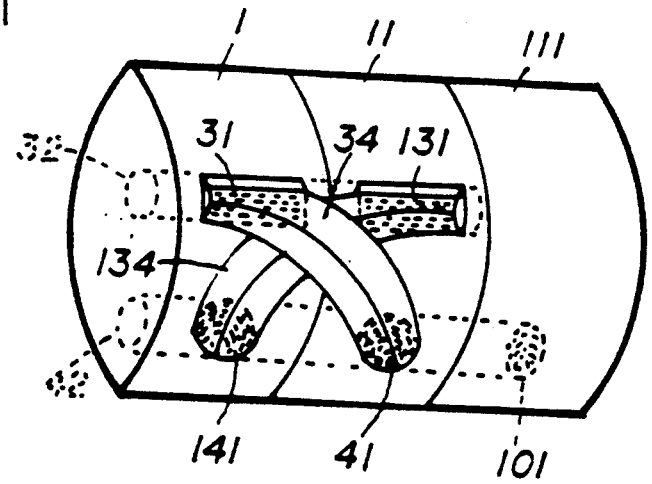
FIG. 10 is the perspective view of the housings and the turbine housing adjacent to the rear rotor housing.
Figure 11:
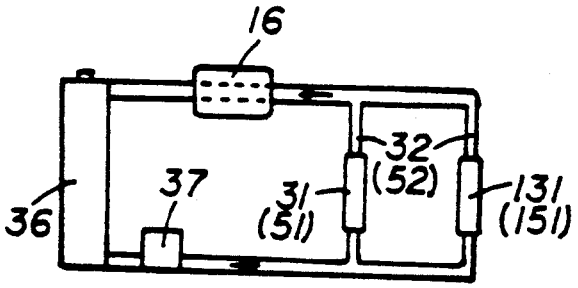
FIG. 11 is the schematic view of one cooling system according to the second embodiment of the invention.
Figure 12:
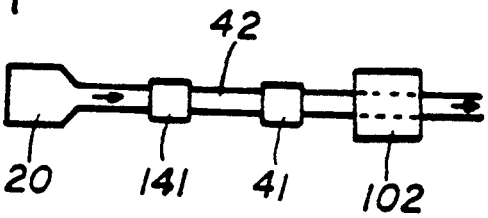
FIG. 12 is the schematic view of one heating system according to the second embodiment of the invention.

The following description present the second embodiment of the present invention shown on FIGS. 10, 11, and 12. According to this embodiment the turbine 111 is adjacent to the rear rotor housing 11. The turbine 111 is connected to the same eccentric shaft 9 and is used to provide additional power in situations when the rotors 6 and 116 do not provide enough force for rapid acceleration. The turbine comprises a fluid container, rotating blades, nozzle valve, and reduction gears (not shown on the drawings).

According to this embodiment, it is proposed that cooling of the working gas is performed by a liquid coolant which is circulated through a radiator 36, water pump 37, cooling tube 32, coolers 31, 131, 51, and 151, and an heat exchanger located inside the air inlet manifold 16 as shown on FIG. 11. The coolant forced by the water pump will flow inside the coolers 31, 131, 51, and 151 where it will absorb the heat from the working gas and will further flow through the heat exchanger located inside the air inlet manifold 16. A portion of the heat absorbed inside the coolers will be released into the incoming air and will raise its temperature. Consequently, this portion of the energy will be recycled into the incoming air instead of being dissipated through the radiator where the rest of the remaining heat is dissipated before the coolant is pumped back into the coolers.

The heating system for the second embodiment shown on FIG. 12 is identical with the previously described embodiment with regard to the burner 20 and heaters 41, 141, 21, and 121. It is the proposal for the second embodiment that after passing through the heaters the burned gases are directed through an heat exchanger located inside the fluid container 101.

Since after passing through the heaters, the burned gases will inevitably still contain certain amount of heat they will be directed through a fluid container 101 wherein the remaining heat will be absorbed by fluid, such as water or some kind of gas (helium). This amount of energy will be stored inside the container in form of steam or high-pressurized gas in order to power a turbine which is connected to the main shaft.

As known from the prior art, Stirling cycle engines do not provide for a rapid acceleration which is a significant disadvantage when used as a power plants in vehicles. Therefore, it is a proposal of this invention to store the remaining amount of energy from the burning gases and use this energy to power the turbine for the purpose of rapid acceleration when required. Namely, assuming that the rotors powered through the Stirling cycle process will provide enough force to propel a vehicle during most of the driving, the excessive amount of energy (one which can not be consumed by the working gas and will normally be wasted in exhaust) can be stored and used for a few seconds when the vehicle accelerates from a stand-still or when short-time acceleration is required. Also, since this turbine will be used only for a relatively very short time, it can be relatively simple and cost-effective unit. It is proposed that the turbine is connected to the shaft by means of an overrunning clutch which will enable the turbine to be held stationary during most of the time and to exert the torque on the shaft when its rotating speed exceeds that of the shaft. This will happen only when a valve is released and high-pressurized steam or gas streams out of the container and propels the turbine.

It is to be understood that the present invention has been described in relation to a particular embodiment, herein chosen for the purpose of illustration and that the claims are intended to cover all changes and modifications, apparent to those skilled in the art which do not constitute a departure from the scope and spirit of the invention.

I claim:

1. An external combustion rotary engine comprising:

a plurality of housings each having an oval chamber shaped in the form of an epitrochoid curve;

at least one rotor enclosed inside each housing, each rotor having substantially triangular shape forming three rotor lobes which separate the housing into four distinct chambers, and each rotor rotatably received within these housings so as to vary the volume of said chambers;

four fluid passages, each fluid passage connecting one of the chambers of each housing to a respective chamber of another housing;

a working fluid sealed within the housings and fluid passages;

at least one heat generating unit for heating the working fluid;

at least one heat absorbing and heat discharging unit for selectively cooling the working fluid and heating the working fluid;

wherein the heat generating unit and the heat absorbing and discharging unit are arranged so as to provide a heater, a preheater and a cooler in each of the fluid passages so as to selectively heat the working fluid to increase the pressure of the working fluid and cool the working fluid to decrease the pressure of the working fluid so as to cause a rotary motion of the rotors within the housings.

2. The external combustion rotary engine of claim 1, wherein the rotors alternately form expansion chambers for the purpose of producing a power thrust and displacing the working fluid through the fluid passages.

3. The external combustion rotary engine of claim 1, further comprising heat circulating tubes connected to the heat generating unit for circulating heat generated in the heat generating unit and wherein each housing has at least two heat passages for circulating the heat generated by the heat generating unit, said heat passages connected to the heat circulating tubes.

4. The external combustion rotary engine of claim 1, wherein the working fluid is helium.

5. The external combustion rotary engine of claim 1, wherein refrigerant gas is used as a coolant in the heat absorbing and discharging unit.

6. The external combustion rotary engine of claim 1, wherein the heat generating unit comprises means for providing an air-fuel mixture, means for igniting and burning said air-fuel mixture, means for circulating produced burned gases to be absorbed by the working fluid, means for discharging the heat from said burned gases to be absorbed by an incoming fresh air flow, and means for releasing said burned gases into outside air.

7. The external combustion rotary engine of claim 1, wherein the heat generating unit comprises a fuel atomizer which includes an ultrasonic transducer for atomizing the fuel.

8. The external combustion rotary engine of claim 7, wherein the fuel atomizer comprises:

a fuel storage chamber;

an inlet valve connecting the fuel storage chamber to a supply of fuel;

a fuel atomizing chamber;

an outlet port extending from the fuel atomizing chamber;

a passage connecting the fuel storage chamber to the fuel atomizing chamber so as to allow fuel to flow from the fuel storage chamber to the fuel atomizing chamber;

means for controlling the amount of fuel in the fuel storage chamber and the amount of the fuel in the fuel atomizing chamber; and an ultrasonic transducer provided in the fuel atomizing chamber, the ultrasonic transducer being adapted to vaporize fuel located in the fuel atomizing chamber so as to cause fuel vapor to flow out of the outlet port.

9. An external combustion rotary engine comprising:

first and second trochodial chambers; a substantially triangular shaped rotor rotatably mounted in each of first and second chambers, both rotors mounted on an eccentric shaft;

first and second inlet ports and first and second outlet ports formed in each of the first and second chambers;

a first fluid passageway extending from the first outlet port of the first chamber to the second inlet port of the second chamber, a heater and a cooler provided in said passageway;

a second fluid passageway extending from the first outlet port of the second chamber to the second inlet port of the first chamber, a heater and a cooler provided in said passageway;

a third fluid passageway extending from the first inlet port of the first chamber to the second outlet port of the second chamber, a heater and a cooler provided in said passageway;

a fourth fluid passageway extending from the first inlet port of the second chamber to the second outlet port of the first chamber, a heater and a cooler provided in said passageway; and a working fluid sealed within the chambers and fluid passageways.

10. The external combustion rotary engine of claim 9, wherein the working fluid contained within the housings and fluid passages is divided into two equal portions, one portion circulating through the upper part of the first housing, the first fluid passageway, the lower part of the second housing and the third fluid passageway and the second portion circulating through the upper part of the second housing, the second fluid passageway, the lower part of the first housing, and the fourth fluid passageway.

11. The external combustion rotary engine of claim 9, further comprising a turbine, said turbine connected to the eccentric shaft and including a fluid container.

12. The external combustion rotary engine of claim 9, further comprising a cooling system, said system comprising means for circulating a coolant, means for absorbing the heat from the working fluid, means for discharging the heat from said working fluid to be absorbed by an incoming fresh air flow, and means for releasing the heat into outside air.

13. The external combustion rotary engine of claim 9, wherein the working fluid from one chamber is displaced into another chamber both because of the pressure difference inside the passageway and inside the housing, and the pressure exerted by the rotor.

14. The external combustion rotary engine of claim 9, wherein the working fluid is helium.

15. The external combustion rotary engine of claim 9, comprising two heat generating units each comprising means for providing an air-fuel mixture, means for igniting and burning said air-fuel mixture, means for igniting and burning said air-fuel mixture, means for circulating produced burned gases, means for discharging the heat from said burned gases to be absorbed by the working fluid, means for discharging the heat from said burned gases to be absorbed by a fluid inside the turbine fluid container, and means for releasing said burned gases into outside air.

16. The external combustion rotary engine of claim 15, wherein the means for providing the air-fuel mixture in the heat generating units comprise a fuel atomizer which includes an ultrasonic transducer.

17. The external combustion rotary engine of claim 16, wherein the fuel atomizer comprises:

a fuel storage chamber;

an inlet valve connecting the fuel storage chamber to a supply of fuel;

a fuel atomizing chamber;

an outlet port extending from the fuel atomizing chamber;

a passage connecting the fuel storage chamber to the fuel atomizing chamber so as to allow fuel to flow from the fuel storage chamber to the fuel atomizing chamber;

means for controlling the amount of fuel in the fuel storage chamber and the amount of fuel in the fuel atomizing chamber; and an ultrasonic transducer provided in the fuel atomizing chamber, the ultrasonic transducer being adapted to vaporize fuel located in the fuel atomizing chamber so as to cause fuel vapor to flow out of the outlet port.

* * * * *